US009312972B2

(12) United States Patent
Elenes

(10) Patent No.: US 9,312,972 B2
(45) Date of Patent: Apr. 12, 2016

(54) METHODS AND SYSTEMS FOR BLENDING BETWEEN ANALOG AND DIGITAL BROADCAST SIGNALS

(71) Applicant: Silicon Laboratories Inc., Austin, TX (US)

(72) Inventor: Javier Elenes, Austin, TX (US)

(73) Assignee: Silicon Laboratories Inc., Austin, TX (US)

( * ) Notice: Subject to any disclaimer, the term of this patent is extended or adjusted under 35 U.S.C. 154(b) by 323 days.

(21) Appl. No.: 13/906,607

(22) Filed: May 31, 2013

(65) Prior Publication Data

US 2014/0355764 A1 Dec. 4, 2014

(51) Int. Cl.

| | |
|---|---|
| ***H04H 20/22*** | (2008.01) |
| ***H04H 20/88*** | (2008.01) |
| ***H04H 20/30*** | (2008.01) |
| *H04H 40/81* | (2008.01) |

(52) U.S. Cl.

CPC ..... *H04H 20/88* (2013.01); *H04H 20/22* (2013.01); *H04H 20/30* (2013.01); *H04H 40/81* (2013.01)

(58) Field of Classification Search

CPC ..... H04H 20/00; H04H 20/80; H04H 20/22; H04H 40/81

USPC ..... 375/316, 322, 324; 381/2

See application file for complete search history.

(56) References Cited

U.S. PATENT DOCUMENTS

| | | | | |
|---|---|---|---|---|
| 7,272,375 | B2 | 9/2007 | Tuttle et al. | |
| 7,949,319 | B2 | 5/2011 | Tuttle et al. | |
| 8,023,918 | B2 | 9/2011 | Hanawalt et al. | |
| 8,195,115 | B2 | 6/2012 | Tuttle et al. | |
| 8,358,994 | B2 | 1/2013 | Li | |
| 8,417,206 | B2 | 4/2013 | Allen et al. | |
| 2006/0083380 | A1 * | 4/2006 | Mino et al. | 381/2 |
| 2007/0099591 | A1 * | 5/2007 | Hendrix et al. | 455/343.1 |
| 2012/0082271 | A1 * | 4/2012 | Elenes et al. | 375/343 |
| 2012/0108191 | A1 * | 5/2012 | Henson | 455/160.1 |
| 2013/0343547 | A1 * | 12/2013 | Pahuja et al. | 381/2 |

OTHER PUBLICATIONS

Peyla, "The Structure and Generation of Robust Waveforms for FM In-Band On-Channel Digital Broadcasting", IBiquity Digital Corporation White Sheet, Available from the Internet prior to the filed of the current application, 17 pgs.

Detweiler, "Conversion Requirements for AM & FM IBOC Transmission", IBiquity Digital Corporation, Obtained from Internet May 5, 2013, 7 pgs.

(Continued)

*Primary Examiner* — Kevin M Burd

(74) *Attorney, Agent, or Firm* — Egan, Peterman, Enders & Huston LLP

(57) ABSTRACT

Systems and methods are disclosed that may be implemented to process a received RF spectrum that includes both analog modulated and digitally modulated RF signals to blend between a digital demodulated signal and an analog demodulated signal obtained from the received RF spectrum prior to performing one or more signal quality mitigation operations on the blended signal (e.g., such as stereo blend, hi-cut, etc.). In one embodiment, the digital demodulated signal and the analog demodulated signal may include at least some of the same information, e.g., such as information from simulcast digital and analog channels that are obtained from the same received RF spectrum.

23 Claims, 5 Drawing Sheets

(56) References Cited

OTHER PUBLICATIONS

Johnson, "The Structure and Generation of Robust Waveforms for AM In Band On Channel Digital Broadcasting", IBiquity Digital Corporation, Obtained from Internet May 5, 2013, 10 pgs.

Nease, "IBOC DAB Field Test Platforms", IBiquity Digital Corporation, Obtained from Internet May 5, 2013, 14 pgs.

* cited by examiner

METHODS AND SYSTEMS FOR BLENDING BETWEEN ANALOG AND DIGITAL BROADCAST SIGNALS

FIELD OF THE INVENTION

This invention relates to digital radio receivers and, more particularly, to blending between analog and digital broadcast signals.

BACKGROUND OF THE INVENTION

Analog frequency modulation (FM) broadcast band receivers can be impaired by noise, multipath and interference from blocker signals. These impairments will often show up as static in the stereo audio output for the tuned analog FM channel. Analog frequency demodulated audio signals degrade gradually with noise and channel impairments. Therefore analog FM receivers apply gradual mitigation techniques such as stereo blend (removing stereo content) and hi-cut (attenuating high frequency audio components) to the demodulated audio signal. The amount of mitigation is gradual and based on received signal quality metrics such as signal-to-noise ratio (SNR), received signal strength indicator (RSSI) and multipath indicator. SNR and multipath metrics can be computed, for example, by analyzing the amplitude modulation in the received FM signal.

FIG. 1 illustrates an example of a conventional stereo blending relationship for the demodulated audio signal of an analog FM receiver, showing percentage stereo as a function of radio frequency (RF) SNR. In FIG. 1, full stereo (100% stereo) is output at the RF SNR value corresponding to point b, and full mono (or 0% stereo) is output at the RF SNR value corresponding to point a, with percentage stereo output varying from 0% to 100% at SNR values between point a and b according to the relationship shown. FIG. 2 illustrates an example of conventional hi-cut filter attenuation (demodulated audio corner frequency) as a function of RF SNR for a conventional FM receiver that results in a gradual drop in high frequency audio signal components with decreasing SNR. In FIG. 2, full audio signal frequency bandwidth is produced at the SNR value corresponding to point d (corner frequency maximum), while a reduced minimum audio signal frequency bandwidth is produced at the SNR value corresponding to point c (corner frequency minimum). The amount of high frequency components decreases between the SNR values of point d and c according to the relationship shown. For the illustrated case of FIGS. 1 and 2, the SNR values corresponding to points a, b, c and d that define the region over which mitigation occurs are programmable at circuit design time. Information on receiver signal processing and signal mitigation techniques may be found in U.S. Pat. No. 7,272,375; U.S. Pat. No. 8,023,918; U.S. Pat. No. 8,358,994; and U.S. Pat. No. 8,417,206, each of which is incorporated herein by reference in its entirety.

Digital radios exist that enable reception of digital radio signals that provide improved fidelity over analog radio signals, as well as additional features. Currently in the United States, digital radio is available over-the-air using sidebands to an analog carrier signal. The current system as commercialized in the United States is referred to as so-called HD™ radio or "HD Radio." By way of these sidebands, a broadcaster can provide one or more additional complementary channels to an analog signal. Accordingly, digital or HD™ radios can receive these signals and digitally demodulate them to provide a higher quality audio signal that includes the same content as an analog radio signal, or to provide additional content to the analog radio signal such as supplementary broadcasting available on one or more supplemental digital channels. Typically, a digital radio tuner is incorporated into a HD™ radio solution that also includes a conventional analog FM receiver for handling analog demodulation of a corresponding simulcast FM analog broadcast signal that includes the same information (audio program content) as the HD™ digital broadcast signal. Where audio content of the selected digital demodulated channel is the same as the selected analog demodulated channel, blending from the digital demodulated channel to the analog demodulated channel may occur to resolve situations in which the digital channel is temporarily lost.

In contrast to the gradual degradation of demodulated analog audio signals, digital demodulated (HD™ radio) audio signals degrade abruptly from full audio fidelity to noise over a short range of RF SNR level. Moreover digital radio signals require a higher RF SNR level for demodulation than analog radio signals. As shown in FIG. 3A, audio fidelity of digital demodulated HD™ radio signals abruptly drops from maximum audio signal fidelity (full fidelity signal that is full-stereo and with no hi-cut applied) to all noise (0% fidelity) at a RF SNR level corresponding to loss of the digital signal. Accordingly, HD™ radio systems switch the audio output from the digital demodulated HD™ digital audio signal to the analog demodulated FM analog audio signal when the received RF signal level drops below a selected SNR threshold slightly above the level corresponding to loss of digital audio. Conversely, when the RF SNR again increases above a selected SNR threshold, the reverse operation occurs, i.e., the audio output is switched from the analog demodulated audio signal to the digital demodulated audio signal.

The switching event between demodulated digital audio signal to demodulated analog audio signal (and vice-versa) is commonly referred to as the in-band on-channel (IBOC) blend. This IBOC blend operation is a cross-fade operation over time (typically a few seconds) between the two audio sources, and is under control of the HD demodulator, which produces a 1-bit blend control signal (blend flag) that triggers the blend operation as shown in FIG. 3B. In this regard, a 0-to-1 transition of the blend flag triggers a crossfade into digital, a 1-to-0 transition triggers a crossfade into analog. The blending threshold from demodulated digital audio signal to demodulated analog audio signal and the blending threshold from demodulated analog audio signal to demodulated digital audio signal are set above the loss of digital audio point and there is typically some hysteresis to these thresholds In a mobile receiver environment, the IBOC blend can occur often, causing the user to experience abrupt changes in audio fidelity between full-fidelity digital audio and partial fidelity FM audio (e.g., mono blended or hi-cut FM audio) over some RF signal levels. Under such conditions, some users may use radio settings to disable high definition reception.

FIG. 4 illustrates a block diagram of a conventional digital FM radio receiver system 400 that includes analog receiver circuitry. As shown, system 400 includes an antenna 402 that is coupled to RF front end circuitry 404, which includes a mixer to downconvert incoming RF signals to a lower frequency. The output of RF front end circuitry 404 is provided to analog-to-digital conversion (ADC) circuitry 406, which provides a digitized signal output to digital front end circuitry 408 that performs tasks such as channelization and filtering. Digital front end circuitry in turn provides the same radio channel information as processed output signals to an analog demodulation path that includes FM discriminator (demodulation) circuitry 410 and to a digital demodulation path that includes HD™ demodulation circuitry 430 as shown. FM discriminator circuitry 410 in turn provides analog demodulated (multiplex) signals to FM multiplex (MPX) decoder circuitry 412 that in turn produces separate L+R (left plus right) and L−R (left minus right) signals as shown. HD™ demodulation circuitry 430 digital demodulates the processed digital information from digital front end circuitry 408 and provides a HD™ demodulated L (left) and R (right) signals according to an $I^2S$ protocol. Also shown coupled to the input of the FM discriminator is signal metrics circuitry 420 that measures signal quality metrics on the modulated FM signal such as SNR, RSSI, and multipath. FM signal metrics circuitry 422 is coupled to the output of the FM discriminator and measures signal quality metrics on the FM demodulated signals such as audio SNR and DC offset.

Still referring to FIG. 4, the separate demodulated L+R and L−R signals from FM multiplex (MPX) decoder circuitry 412 are next provided to signal quality mitigation components 450 that include hi-cut circuitry 414 and stereo blend circuitry 416. The separate L+R and L−R signals are processed in block 450 by hi-cut circuitry 414 that varies the audio frequency bandwidth according to the varying signal quality metrics received from metrics circuitry 420 using a frequency bandwidth control relationship such as described in relation to FIG. 2. The separate L+R and L−R signals are then blended together between full stereo and full mono FM audio output by stereo blend circuitry 416 according to varying signal quality metrics received from metrics circuitries 420 and 422 using a stereo blending relationship such as described in relation to FIG. 1. The resulting mitigated demodulated FM audio signal including left and right audio signals is then provided to IBOC blend circuitry 418 from signal quality mitigation circuitry components 450. IBOC blend circuitry 418 includes a cross-fader that blends between demodulated FM stereo audio signal output and HD™ demodulation circuitry 430 audio output according to a blend control signal received from HD™ demodulation circuitry 430 as shown. The blend control signal from HD™ demodulation circuitry 430 controls blend circuitry 418 to implement the IBOC blend cross-fade operation described in relation to FIG. 3B in response to varying SNR of processed digital signal from digital front end 408. Using the conventional system architecture of FIG. 1, demodulated FM audio signals (left and right audio) that are potentially mitigated by stereo blend and/or hi-cut operations described above are then provided to IBOC blend circuitry 418 along with full fidelity HD™ audio signals from HD™ demodulation circuitry 430 such that IBOC blend circuitry cross fades between two audio signals (demodulated FM analog broadcast and demodulated HD™ digital broadcast) that differ in audio fidelity under certain received RF signal conditions. Information regarding digital radio receiver processing and blending techniques for digital and analog signals may be found in United States Patent Publication No. 2012/0082271; United States Patent Publication No. 2012/0108191; and in U.S. Pat. No. 8,195,115 each of which is incorporated herein by reference in its entirety.

SUMMARY OF THE INVENTION

Disclosed herein are systems and methods that may be implemented to process a received RF spectrum that includes both analog modulated and digital modulated RF signals. In particular, the disclosed systems and methods may be implemented to blend between a digital demodulated signal and an analog demodulated signal obtained from the same received RF spectrum prior to performing one or more signal quality mitigation operations on the blended signal (e.g., such as stereo blend, hi-cut, etc.). In one embodiment, the digital demodulated signal and the analog demodulated signal may include at least some of the same information, e.g., such as information from simulcast digital and analog channels that are obtained from the same received RF spectrum.

In one exemplary embodiment, the disclosed systems and methods may be implemented in a digital radio receiver system that includes both analog demodulation path and digital demodulation path circuitry (e.g., such as HD™ radio systems) to achieve substantially seamless cross-fading between analog demodulated audio signals and digital demodulated audio signals obtained from the same received RF spectrum. In this regard, the disclosed systems and methods may be implemented in one embodiment to prevent abrupt changes in output audio fidelity and enhance user experience by keeping the output audio fidelity substantially constant as the digital radio receiver system blends back and forth between analog demodulated audio signals and digitally demodulated audio signals, e.g., such as in a mobile receiver environment where blending may occur frequently in either direction. One example of such a mobile receiver embodiment is operation of a vehicle mounted digital radio system as the vehicle moves from point to different points relative to radio transmitters and/or under conditions of varying topography. Because the signal quality mitigation operations are performed after digital/analog blending, signal quality mitigation (e.g., such as stereo blend, hi-cut, etc.) may be used to intentionally reduce the audio fidelity of the digital demodulated signal near the digital/analog blend point in a manner that makes blending between the digital and audio content less perceptible or substantially not perceptible, e.g., the same stereo quality mitigation settings may be applied to both the digital demodulated signal and the analog demodulated signal across the digital/analog blending transition point such that there is little difference or substantially no difference in audio fidelity between the digital and audio content as cross-fading occurs between the digital and audio content.

In another exemplary embodiment, an unmitigated analog demodulated audio signal (e.g., FM audio signal) may be first blended with a simulcast unmitigated digital demodulated audio signal (e.g., HD™ audio signal) that includes the same audio information (audio program content) as the analog demodulated audio signal prior to performance of signal quality mitigation operations on the blended demodulated audio signal. Advantageously, the disclosed systems and methods may be further configured in a manner such that no signal quality mitigation occurs and therefore full audio fidelity is preserved at moderate to high received RF signal levels (or SNR) where only digital demodulated signals are output by a digital receiver system, and such that signal quality mitigation begins occurring before RF signal quality reaches relatively lower RF signal levels (lower SNR) where blending to analog demodulated signals occurs in order to equalize audio fidelity between the analog demodulated and digital demodulated signals before blending begins.

In one respect, disclosed is a method for processing signals, including: performing a digital/analog blending operation between a digital demodulated signal obtained from a digital modulated signal contained in a received radio frequency (RF) spectrum and an analog demodulated signal obtained from an analog modulated signal contained in the same received RF spectrum to produce a post-blend demodulated signal; and then performing one or more signal quality mitigation operations on the post-blend demodulated signal.

In another respect, disclosed herein is a system, including digital/analog signal blend circuitry that itself includes: a first input to receive a digital demodulated signal obtained from a digital modulated signal contained in a received radio frequency (RF) spectrum, a second input to receive an analog demodulated signal obtained from an analog modulated signal contained in the same received RF spectrum, and an output to provide a post-blend demodulated signal, the digital/analog signal blend circuitry being configured to perform a digital/analog blending operation between the digital demodulated signal and the analog demodulated signal to produce a post-blend demodulated signal; and signal quality mitigation circuitry having an input coupled to the output of the digital/analog signal blend circuitry, the signal quality mitigation circuitry being configured to perform one or more signal quality mitigation operations on the post-blend demodulated signal to produce a mitigated output signal from the signal quality mitigation circuitry.

BRIEF DESCRIPTION OF THE DRAWINGS

It is noted that the appended drawings illustrate only example embodiments of the invention and are, therefore, not to be considered limiting of its scope, for the invention may admit to other equally effective embodiments.

DESCRIPTION OF ILLUSTRATIVE EMBODIMENTS

Figure 5:
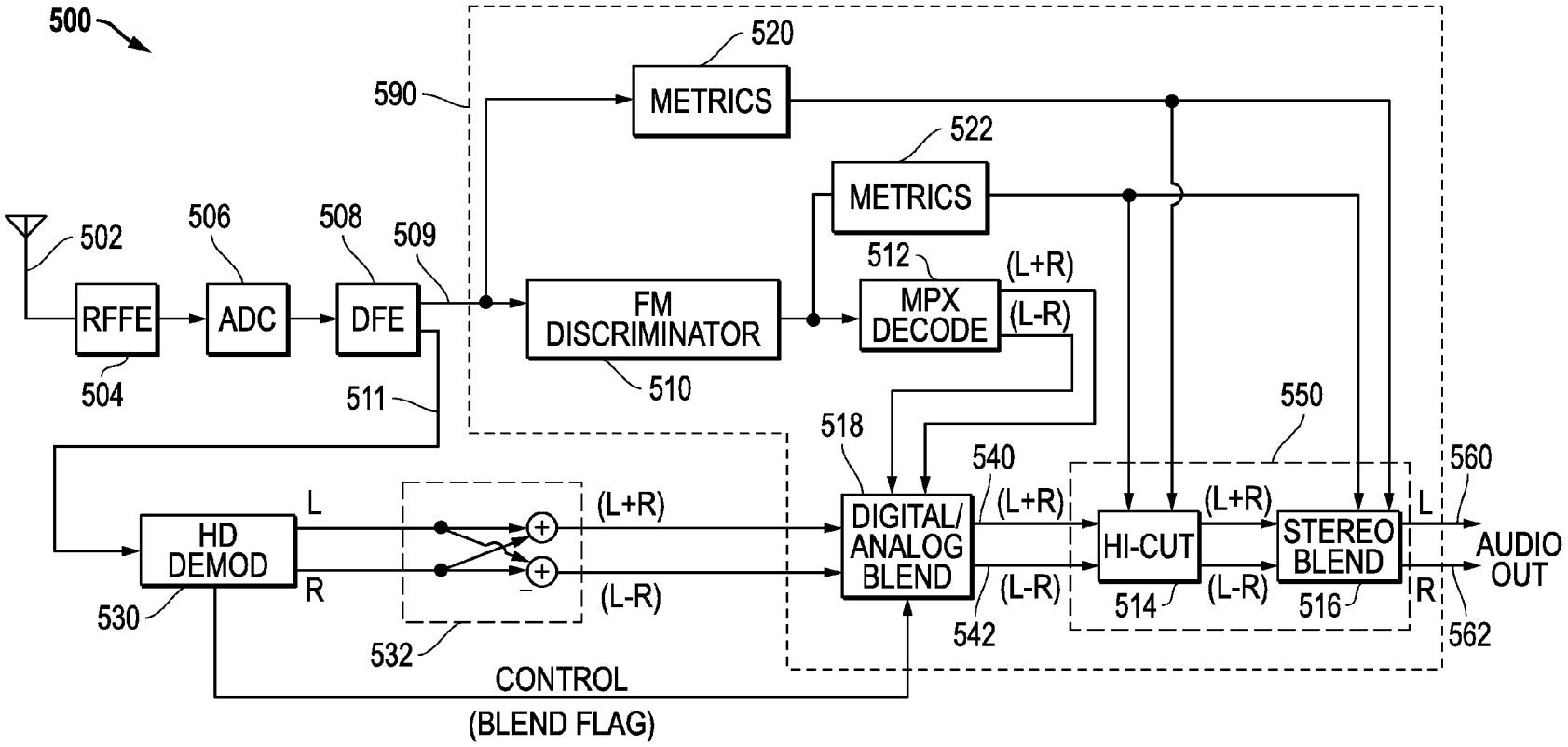
FIG. 5 illustrates a block diagram of a digital radio receiver system according to one exemplary embodiment of the disclosed systems and methods.

FIG. 5 illustrates a block diagram of one exemplary embodiment of a digital radio receiver system 500 that includes analog receiver circuitry. As shown, system 500 includes an antenna 502 that is coupled to provide a received RF spectrum to RF or analog front end circuitry 504, which may include a mixer to downconvert incoming RF signals to a lower frequency (e.g., intermediate frequency (IF) signal, low-IF signal, baseband signals, etc.) as well as any other processing tasks suitable for the particular given system embodiment. In this embodiment, received RF signals may include digital modulated broadcast signals (e.g., such as HD™ digital broadcast signals) that are simulcast with analog modulated broadcast signals (e.g., FM broadcast signals) that include the same audio program content as the digital modulated broadcast signals. Although this exemplary embodiment is described in relation to an RF spectrum including a combination of analog FM broadcast signals and simulcast digital broadcast signals (e.g., such as HD™ digital broadcast signals) present as one or more sidebands to the analog FM carrier signal, it will be understood that the disclosed systems and methods may be implemented to similarly receive and process a RF spectrum including any combination of simulcast digital modulated and analog modulated signals that share at least some of the same information such as audio and/or other program content. Examples of suitable RF spectrum communications include those made in accordance with various standards such as Digital Audio Broadcasting, Digital Radio Mondiale or other standard. Other examples may include digital broadcast signals that are present in one or more sidebands to an AM carrier signal, or any other combination of digital modulated and analog modulated broadcast signals that are received in the same RF spectrum.

Still referring to the illustrated embodiment of FIG. 5, the output of RF front end circuitry 504 may be provided to analog-to-digital conversion (ADC) circuitry 506, which provides a digitized signal output to digital front end circuitry 508 that may perform tasks such as channelization and filtering. As shown, digital front end circuitry may in turn provide radio channel information as processed output signals both to an analog demodulation path that includes analog demodulation circuitry in the form of FM discriminator (demodulation) circuitry 510 and to a digital demodulation path that includes digital demodulation circuitry in the form of digital signal (e.g., HD™ signal) demodulation circuitry 530 as shown. In this regard, DFE circuitry 508 may in one exemplary embodiment provide two channelized outputs, a first output 509 for analog FM in which the HD sidebands are filtered out, and a second output 511 for HD in which the analog FM carrier is filtered out.

FM discriminator circuitry 510 in turn provides analog demodulated (multiplex) signals to FM multiplex (MPX) decoder circuitry 512 that may in turn produce separate demodulated L+R and L−R signals therefrom as shown. Digital demodulation circuitry 530 may demodulate the processed digital information from digital front end circuitry 508 and provide digital demodulated left and right signal pair (e.g., as an $I^2S$ serial bus output or other suitable form of signal pair) that may be received and further processed in adder and subtraction circuitry 532 to produce separate demodulated L+R and L−R signals therefrom as shown. Although FIG. 5 illustrates particular examples of analog and digital demodulation circuitries, it will be understood that analog demodulation circuitry and digital demodulation circuitry may be implemented with any configuration of demodulation circuitry suitable for demodulating the given types of analog and digital modulated signals processed in a given embodiment.

In the illustrated embodiment, analog demodulated L+R and L−R signals from MPX decoder circuitry 512 and digital demodulated L+R and L−R signals from adder and subtraction circuitry 532 may be each provided in unmitigated form to digital/analog signal blend circuitry 518. Digital/analog signal blend circuitry 518 may be for example, IBOC blend circuitry, or may be alternatively be any other configuration of blending circuitry suitable for blending from the digital demodulated L+R and L−R signals to the analog demodulated L+R and L−R signals as indicated by the control signal provided by the HD demodulator. In the exemplary embodiment of FIG. 5, a digital/analog blend control signal (e.g., as a blend flag) from digital/analog signal blend circuitry 518 that is integrated within HD™ demodulation circuitry 530 may be provided to digital/analog signal blend circuitry 518 as shown to control blend circuitry 518 to implement a blending operation between unmitigated L+R and L−R signals from MPX decoder circuitry 512 and unmitigated L+R and L−R signals from adder and subtraction circuitry 532 in order to produce unmitigated post-blend L+R and L−R signals 540 and 542 that may be provided to signal quality mitigation circuit components 550. In one exemplary embodiment, digital/analog signal blend circuitry 518 may blend between the L+R and L−R signals from MPX decoder circuitry 512 and the L+R and L−R signals from adder and subtraction circuitry 532 using, for example, a cross-fade operation in response to a control signal from HD™ demodulation circuitry 530 that is based on varying SNR of processed digital signal from digital front end circuitry 508. Some examples of blending techniques and blending control for digital and analog signals that may be employed by blend circuitry 518 may be found in United States Patent Publication No. 2012/0082271; United States Patent Publication No. 2012/0108191; and in U.S. Pat. No. 8,195,115 each of which has been incorporated herein by reference in its entirety.

Still referring to FIG. 5, it will be understood that in other embodiments signal quality mitigation circuitry 550 may include any suitable combination of one or more signal mitigation circuit components, e.g., including fewer, additional and/or alternative signal mitigation components. For example, it is possible that only one of circuit components 514 and 516 may be present to mitigate the output signals from digital/analog signal blend circuitry 518, or that additional and/or alternative types of signal mitigation components may be present. Some examples of signal mitigation techniques that may be employed by signal quality mitigation components 550 may be found in U.S. Pat. No. 7,272,375; U.S. Pat. No. 8,023,918; U.S. Pat. No. 8,358,994; and U.S. Pat. No. 8,417,206, each of which has been incorporated herein by reference in its entirety.

Figure 1:
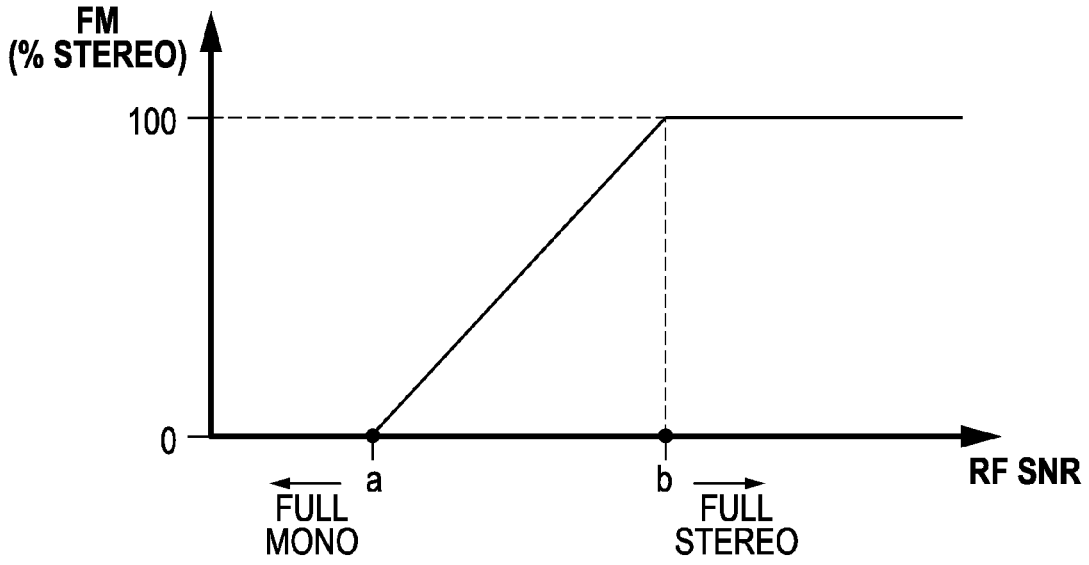
FIG. 1 (Prior Art)
FIG. 1 illustrates an example of a conventional stereo blending relationship for FM audio signals.
Figure 2:
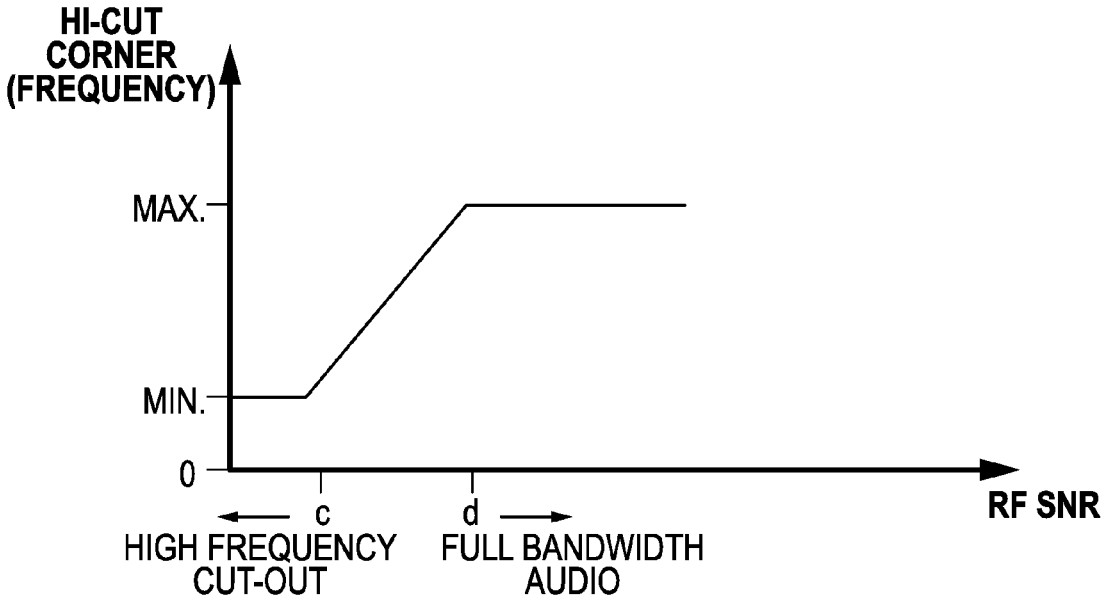
FIG. 2 (Prior Art)
FIG. 2 illustrates an example of conventional hi-cut filter attenuation for FM audio signals.
Figure 3A:
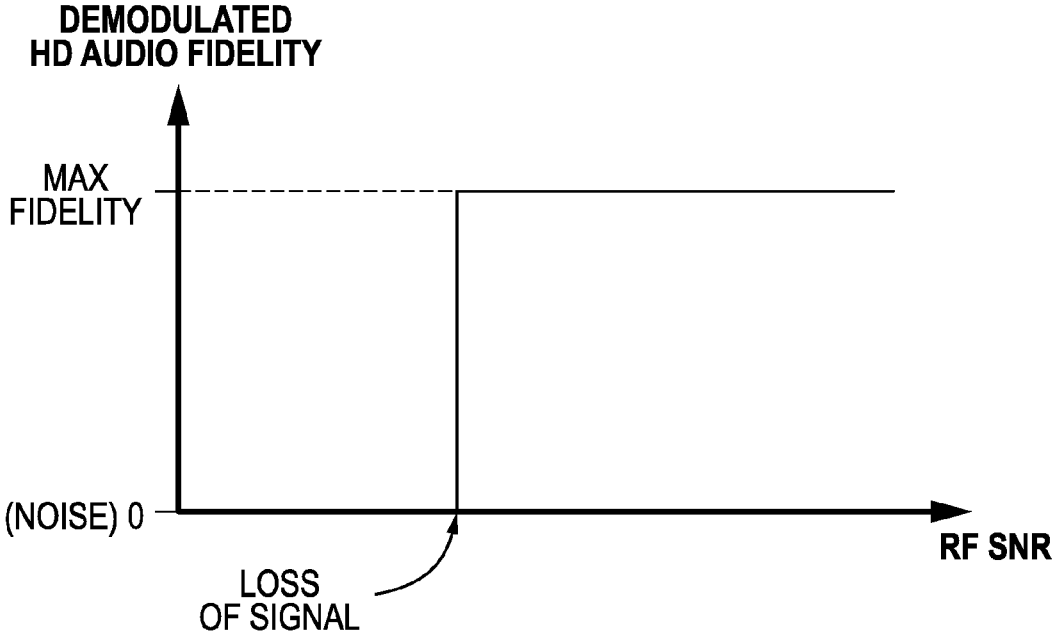
FIG. 3A (Prior Art)
FIG. 3A illustrates a conventional relationship between audio fidelity of demodulated HD™ radio signals and RF SNR.
Figure 3B:
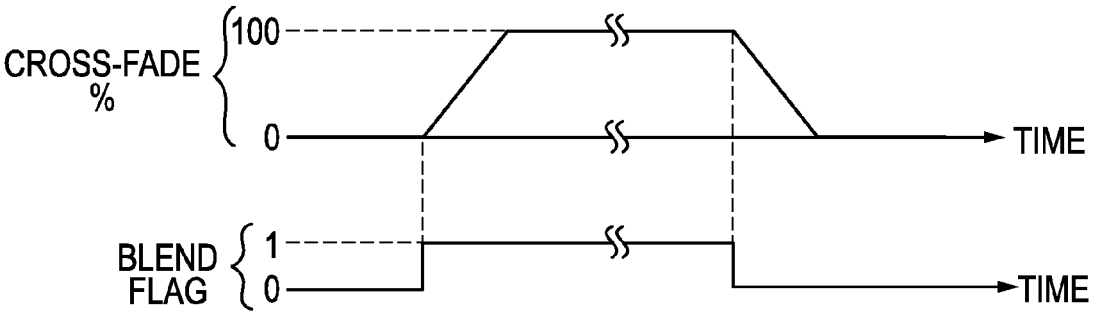
FIG. 3B (Prior Art)
FIG. 3B illustrates a conventional relationship between a blend control signal and a cross-fade blending operation.
Figure 4:
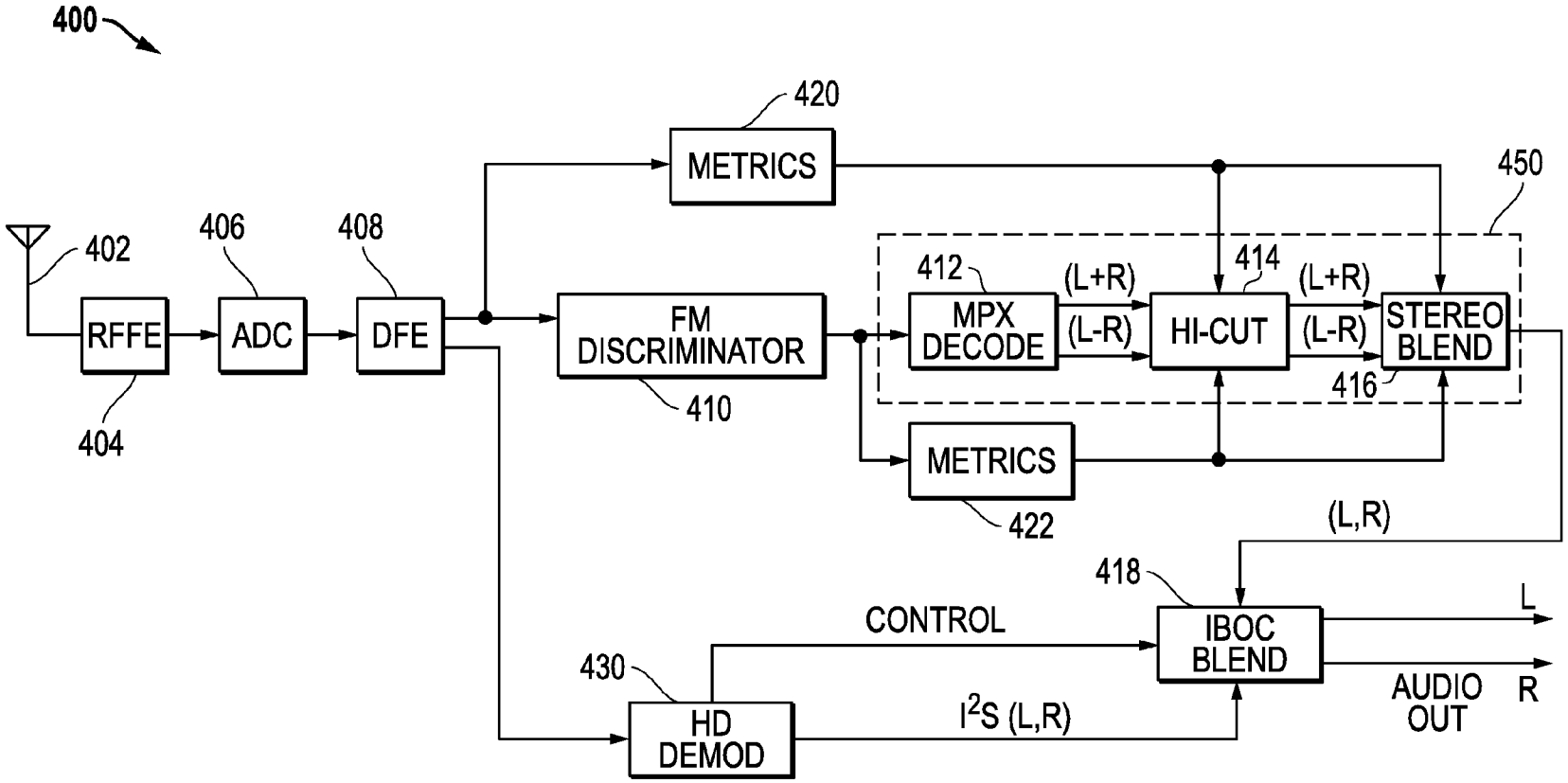
FIG. 4 (Prior Art)
FIG. 4 illustrates a block diagram of a conventional digital FM radio receiver system.

As shown, in the circuitry of block 550 the separate demodulated post-blend L+R and L−R signals 540 and 542 from digital/analog signal blend circuitry 518 may be processed by hi-cut circuitry 514 that varies the audio frequency bandwidth according to the varying signal quality metrics received from metrics circuitry 520, e.g., using a frequency bandwidth control relationship such as described in relation to FIG. 2 or other suitable frequency bandwidth relationship. The output of hi-cut circuitry 514 may then be blended together between full stereo and full mono audio output by stereo blend circuitry 516 according to varying measured signal quality metric values received from metrics circuitries 520 and/or 522 using a stereo blending relationship such as described in relation to FIG. 1 or using any other suitable blending relationship. For example, a full stereo output from stereo blend circuitry 516 may be created by generating a left (L) channel audio output by adding the L+R and L−R signals and dividing by 2 (to give L), and a right (R) channel audio output signal created by subtracting the L−R signal from the L+R signal and dividing by 2 (to give R). A mono output may be created by nulling the (L−R) contribution to the stereo signal such that (L+R) is output on both the right (R) channel signal and on the left (L) channel signal. Blends between stereo and mono may be created by adding or subtracting L−R from L+R in a weighted fashion. In one embodiment, signal quality mitigation circuitry 550 may be configured to perform signal quality mitigation on the post-blend demodulated signals 540 and 542 if a measured first signal quality metric value (e.g., from metrics circuitries 520 and/or 522) is not greater than a maximum signal quality mitigation threshold value, and to not perform signal quality mitigation on the post-blend demodulated signal if the measured first signal quality metric value is not greater than a maximum signal quality mitigation threshold value As further shown in FIG. 5, signal quality mitigation circuitry 550 may produce mitigated stereo output signals in the form of a left (L) channel signal 560 and a right (R) channel signal 562. In this regard, DSP 590 may be configured so that output signals 560 and 562 are output from DSP 590 as digital left and right stereo signals, and in one embodiment optional digital-to-analog conversion (DAC) circuitry may also be provided to optionally convert output signals 560 and 562 to analog left and right stereo signals that may be provided to amplifiers and/or speakers, etc.

In the exemplary embodiment of FIG. 5, metrics circuitry 520 may be provided to measure signal quality metrics (e.g., SNR, RSSI, multipath, etc.) of the FM modulated output signal of digital front end circuitry 508, and metrics circuitry 522 may be provided to measure signal quality metrics (e.g., audio SNR, DC offset, etc.) of the demodulated FM signal output of FM discriminator circuitry 510 as shown. It will be understood that in other embodiments signal quality mitigation circuitry components 550 may be configured to receive and mitigate the demodulated L+R and L−R output signals of digital/analog blend circuitry 518 based on signal quality metrics signals provided by only one of metrics circuitries 520 or 522, or based on signal quality metrics signals provided by any other configuration of metrics circuit's that are present to measure signal quality metrics of modulated RF signals received by system 500 and/or signal quality metrics of analog or digital demodulated signals processed by system 500. Some examples of signal mitigation techniques that may be employed by signal quality mitigation components 550 may be found in U.S. Pat. No. 7,272,375; U.S. Pat. No. 8,023,918; and U.S. Pat. No. 8,417,206, each of which has been incorporated herein by reference in its entirety.

Advantageously, the disclosed systems and methods may be configured in one exemplary embodiment such that no signal quality mitigation (such as stereo blend or hi-cut) is performed by circuitry 550 at the moderate to high received RF signal levels (or SNR value levels) where digital/analog blend circuitry 518 outputs full digital demodulated signals (e.g., HD™ digital broadcast signals) received from HD demodulation circuitry 530, so that full fidelity left and right digital demodulated signals are preserved and output as L and R audio signals 560 and 562. However, signal mitigation circuitry 550 may also be configured to have already begun mitigating the digital signals (e.g., HD™ digital broadcast signals) produced by digital/analog blend circuitry 518 before digital/analog blend circuitry 518 begins blending from digital demodulated signals to analog demodulated signals as RF signal quality approaches relatively lower RF signal levels (e.g., near the minimum SNR threshold where digital to analog signal blending begins). In this way, the audio fidelity between the analog demodulated signals and digital demodulated signals is equalized at lower RF signal levels as signal quality (SNR) drops and before blending occurs from all digital demodulated signal output to all analog demodulated signal output.

It will be understood that in one embodiment of the practice of the disclosed systems and methods, the mechanisms for analog/digital blend (e.g., circuitry 518), hi-cut (e.g., circuitry 514) and stereo blend (e.g., circuitry 516) may operate independently of each other. In this regard, blending operations of digital/analog blend circuitry 518 may be controlled by digital demodulation circuitry 530 which may employ internal digital signal quality metrics to decide whether or not to blend between analog demodulated signal and digital demodulated signal using blend flag control signals, regardless of the state of hi-cut circuitry 514, stereo blend circuitry, and/or any other mitigation components 550. Further, the digital signal quality metrics considered by digital demodulation circuitry 530 may be different from the analog signal quality parameters that only concern analog signal quality and that are used by metrics circuitries 520 and/or 522 to control operation of signal quality mitigation circuit components 550. In the same way, signal mitigation circuit components 550 (e.g., hi-cut circuitry 514 and stereo blend circuitry 516) may be driven by the analog signal metrics circuitries 520 and 522 regardless of the state of analog/digital blend circuitry 518.

It will also be understood that it is possible that one or more of the separate circuit blocks of FIG. 5 may be implemented together in a common circuit, as well as separately in different circuits. Further, as shown in FIG. 5, one or more blocks of system 500 may be optionally implemented in one exemplary embodiment by a digital signal processor (DSP) 590. In this regard, a DSP may be implemented, if desired, by using a microcontroller and appropriate software code or firmware that may be loaded into memory storage associated with the microcontroller. In addition, a DSP may be implemented with hardware or any suitable combination/s of hardware, firmware and/or software, as desired. It is also possible that the functionality of circuit blocks of systems 500 and 600 of respective FIGS. 5 and 6 may be implemented in one exemplary embodiment on a single semiconductor die.

Figure 6:
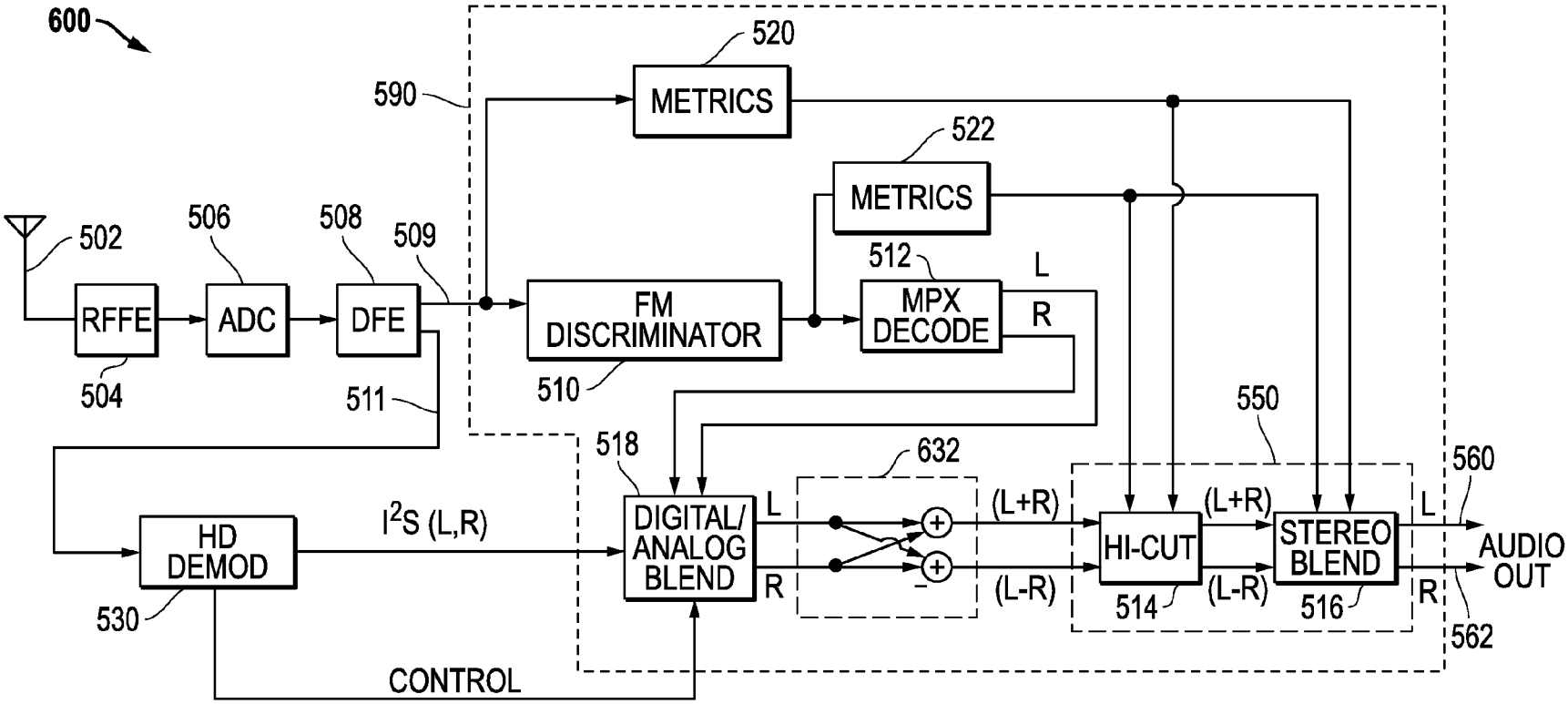
FIG. 6 illustrates a block diagram of a digital radio receiver system according to one exemplary embodiment of the disclosed systems and methods.

FIG. 6 illustrates a block diagram of an alternative exemplary embodiment of a digital radio receiver system 600 that includes analog receiver circuitry. This embodiment has a similar architecture to system 500 of FIG. 5, except that respective analog demodulated and digital demodulated L,R signal pairs are provided to digital/analog blend circuitry 518 as shown, i.e., rather than as (L+R) and (L−R) signals as illustrated in FIG. 5. In this alternative embodiment, the L,R signals output signals from 518 may be provided to adder and subtraction circuitry 632 as shown, which forms that are provided to signal mitigation circuitry 550.

It will also be understood that one or more of the tasks, functions, or methodologies described herein may be implemented, for example, as firmware or other computer program of instructions embodied in a non-transitory tangible computer readable medium that is executed by a CPU, microcontroller, or other suitable processing device.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed systems and methods may be utilized in various combinations and/or independently. Thus the invention is not limited to only those combinations shown herein, but rather may include other combinations.

What is claimed is:

1. A method for processing signals, comprising:

performing a digital/analog blending operation between digital demodulated signals obtained from digital modulated signals contained in a received radio frequency (RF) spectrum and analog demodulated signals obtained from analog modulated signals contained in the same received RF spectrum to produce a post-blend demodulated left plus right (L+R) signal and a post-blend demodulated left minus right (L−R) signal; and then performing stereo-to-mono blending operations on the post-blend demodulated (L+R) and (L−R) signals.

2. The method of claim 1, further comprising:

receiving the RF spectrum;

downconverting analog signals in the RF spectrum that include the analog modulated signals and the digital modulated signals;

digitizing the downconverted analog signals of the RF spectrum to output digital signals that include the analog modulated signals and the digital modulated signals of the RF spectrum; and digitally processing the digital signals that include the analog modulated signals and the digital modulated signals to:

analog demodulate and decode the analog modulated signals to produce analog demodulated left and right signals, digital demodulate the digital modulated signals to produce digital demodulated left and right signals, perform the digital/analog blending operation between the analog demodulated left and right signals and the digital demodulated left and right signals to produce post-blend demodulated left and right signals add the post-blend demodulated left and right signals to produce the post-blend demodulated (L+R) signal and subtract the post-blend demodulated right signal from the post-blend demodulated left signal to produce the post-blend demodulated (L−R) signal, and perform the stereo-to-mono blending operations on the post-blend demodulated (L+R) and (L−R) signals to output digital signals related to demodulated content from the post-blend demodulated (L+R) and (L−R) signals.

3. The method of claim 1, where the digital demodulated signals and the analog demodulated signals include at least some of the same information.

4. The method of claim 1, where the analog demodulated signals comprise analog audio content demodulated from the analog modulated signals that is centered on a center frequency for an audio broadcast channel received in the RF spectrum; and where the digital demodulated signals comprise digital audio content demodulated from the digital modulated signals located in one or more sideband frequency ranges offset from the center frequency.

5. The method of claim 4, where the analog audio content and digital audio content each comprise the same simulcast audio information.

6. The method of claim 1, where the step of performing stereo-to-mono blending operations on the post-blend demodulated (L+R) and (L−R) signals comprises determining whether to stereo-to-mono blend the post-blend demodulated (L+R) and (L−R) signals based on one or more measured first signal quality metrics of modulated signals in the received RF spectrum, the analog demodulated signals, or a combination thereof.

7. The method of claim 6, where the step of performing stereo-to-mono blending operations on the post-blend demodulated (L+R) and (L−R) signals on the post-blend demodulated (L+R) and (L−R) signals signal comprises:

measuring at least one first signal quality metric value of at least one of modulated signals in the received RF spectrum, the analog demodulated signals, or a combination thereof;

performing stereo-to-mono blending-on the post-blend demodulated (L+R) and (L−R) signals if the measured first signal quality metric value is not greater than a maximum signal quality mitigation threshold value; and not performing stereo-to-mono blending-on the post-blend demodulated (L+R) and (L−R) signals if the measured first signal quality metric value is greater than a maximum signal quality mitigation threshold value.

8. The method of claim 7, further comprising:

reducing the audio frequency bandwidth of the post-blend demodulated (L+R) and (L−R) signals prior to performing stereo-to-mono blending-if the measured first signal quality metric value is not greater than the maximum signal quality mitigation threshold value; and not reducing the audio frequency bandwidth of the post-blend demodulated (L+R) and (L−R) signals if the measured first signal quality metric value is greater than the maximum signal quality mitigation threshold value.

9. The method of claim 1, further comprising:

producing the post-blend demodulated left plus right (L+R) signal and the post-blend demodulated left minus right (L−R) signal only from the digital demodulated signals obtained from the digital modulated signals contained in the received radio frequency (RF) spectrum; and performing stereo-to-mono blending operations on the post-blend demodulated (L+R) and (L−R) signals produced only from the digital demodulated signals before beginning blending from the digital demodulated signals to the analog demodulated signals.

10. The method of claim 1, further comprising:

receiving the RF spectrum;

downconverting analog signals in the RF spectrum that include the analog modulated signals and the digital modulated signals;

digitizing the downconverted analog signals of the RF spectrum to output digital signals that include the analog modulated signals and the digital modulated signals of the RF spectrum; and digitally processing the digital signals that include the analog modulated signals and the digital modulated signals to:

analog demodulate and decode the analog modulated-signals to produce analog demodulated (L+R) and (L−R) signals, digital demodulate the digital modulated signals to produce digital demodulated left and right signals, add the digital demodulated left and right signals to produce a digital demodulated (L+R) signal and subtract the digital demodulated right signal from the digital demodulated left signal to produce a digital demodulated (L−R) signal, perform the digital/analog blending operation between the analog demodulated (L+R) and (L−R) signals and the digital demodulated (L+R) and (L−R) signals to produce the post-blend demodulated (L+R) and (L−R) signals, and perform the stereo-to-mono blending operations on the post-blend demodulated (L+R) and (L−R) signals to output digital signals related to demodulated content from the post-blend demodulated (L+R) and (L−R) signals.

11. A system, comprising:

digital/analog signal blend circuitry comprising:

a first input to receive digital demodulated signals obtained from digital modulated signals contained in a received radio frequency (RF) spectrum, and a second input to receive analog demodulated signals obtained from analog modulated signals contained in the same received RF spectrum, and an output to provide post-blend demodulated signals, the digital/analog signal blend circuitry being configured to perform a digital/analog blending operation between the digital demodulated signals and the analog demodulated signals to produce the post-blend demodulated signals; and either:

(a) where the digital/analog signal blend circuitry is configured to perform the digital/analog blending operation between the digital demodulated signals and the analog demodulated signals to produce post-blend demodulated left and right signals at the output of the digital/analog signal blend circuitry, and the system further comprises:

adder and subtraction circuitry having an input coupled to the output of the digital/analog signal blend circuitry and being configured to add post-blend demodulated left and right signals produced by the output of the digital/analog signal blend circuitry to produce a post-blend demodulated (L+R) signal at an output of the adder and subtraction circuitry and to subtract the post-blend demodulated right signal from the post-blend demodulated left signal to produce a post-blend demodulated (L−R) signal at the output of the adder and subtraction circuitry, and signal quality mitigation circuitry having an input coupled to the output of the adder and subtraction circuitry, the signal quality mitigation circuitry including stereo blend circuitry configured to perform one or more stereo blend operations on the post-blend demodulated (L+R) and (L−R) signals produced by the output of the adder and subtraction circuitry; or (b) where the digital/analog signal blend circuitry is configured to perform the digital/analog blending operation between the digital demodulated signals and the analog demodulated signal to produce a post-blend demodulated left plus right (L+R) demodulated signal and a post-blend demodulated left minus right (L−R) signal at the output of the digital/analog signal blend circuitry, and the system further comprises:

adder and subtraction circuitry having an input coupled to the output of digital demodulator circuitry configured to produce digital demodulated signals obtained from the digital modulated signals contained in the received radio frequency (RF) spectrum, the adder and subtraction circuitry being configured to add post-blend demodulated left and right signals produced by the output of the digital/analog signal blend circuitry to produce a post-blend demodulated (L+R) signal at an output of the adder and subtraction circuitry and to subtract the post-blend demodulated right signal from the post-blend demodulated left signal to produce a post-blend demodulated (L−R) signal at the output of the adder and subtraction circuitry, and signal quality mitigation circuitry having an input coupled to the output of the digital/analog signal blend circuitry, the signal quality mitigation circuitry including stereo blend circuitry being configured to perform stereo blend operations on the post-blend demodulated (L+R) and (L−R) signals produced by the output of the digital/analog signal blend circuitry to produce a mitigated output signal from the signal quality mitigation circuitry.

12. The system of claim 11, where the digital demodulated signals and the analog demodulated signals include at least some of the same information.

13. The system of claim 11, further comprising:

analog demodulation circuitry having an input configured to receive the analog modulated signals, the analog demodulation circuitry being configured to demodulate the analog modulated signals to produce signals at an output of the analog demodulation circuitry, where the second input of the digital/analog signal blend circuitry is coupled to receive analog demodulated signals obtained from the analog signals output by the analog demodulation circuitry; and digital demodulation circuitry having an input configured to receive the digital modulated signals, the digital demodulation circuitry being configured to demodulate the digital modulated signals to produce the digital demodulated signals at an output of the digital demodulation circuitry, where the first input of the digital/analog signal blend circuitry is coupled to receive the digital demodulated signals from the output of the digital demodulation circuitry.

14. The system of claim 13, further comprising:

analog front end circuitry configured to receive the RF spectrum and to downconvert analog signals in the RF spectrum that include the analog modulated signals and the digital modulated signals;

analog-to-digital conversion (ADC) circuitry coupled to receive the downconverted analog signals of the RF spectrum from the analog front end and to output digital signals including the analog modulated signals and the digital modulated signals of the RF spectrum; and a digital signal processor (DSP) including at least the analog demodulation circuitry, the digital/analog signal blend circuitry and the signal quality mitigation circuitry, the DSP being coupled to receive the digital signals output by the ADC circuitry and to output digital signals related to demodulated content from the post-blend demodulated signals processed by the signal quality mitigation circuitry.

15. The system of claim 11, where the analog demodulated signals comprise analog audio content demodulated from the analog modulated signals that is centered on a center frequency for an audio broadcast channel received in the RF spectrum; and where the digital demodulated signals comprise digital audio content demodulated from the digital modulated signals located in one or more sideband frequency ranges offset from the center frequency.

16. The system of claim 15, where the analog audio content and digital audio content each comprise the same simulcast audio information.

17. The system of claim 11, where the signal quality mitigation circuitry is configured to determine whether to stereo-to-mono blend the post-blend demodulated (L+R) and (L−R) signals based on one or more measured first signal quality metrics of modulated signals in the received RF spectrum, the analog demodulated signals, or a combination thereof.

18. The system of claim 17, further comprising signal quality metrics circuitry coupled to the signal quality mitigation circuitry, the signal quality metrics circuitry configured to:

measure at least one first signal quality metric value of modulated signals in the received RF spectrum, the analog demodulated signals, or a combination thereof; and provide a signal representative of the measured first signal quality metric value to the signal quality mitigation circuitry;

where the the signal quality mitigation circuitry is configured to stereo-to-mono blend the post-blend demodulated (L+R) and (L−R) signals based on the measured first signal quality metric value provided from the signal quality metrics circuitry.

19. The system of claim 18, where the signal quality mitigation circuitry is configured to:

perform stereo-to-mono blending-on the post-blend demodulated (L+R) and (L−R) signals if the measured first signal quality metric value is not greater than a maximum signal quality mitigation threshold value; and not perform stereo-to-mono blending-on the post-blend demodulated (L+R) and (L−R) signals if the measured first signal quality metric value is greater than a maximum signal quality mitigation threshold value.

20. The system of claim 19, where the signal quality mitigation circuitry is configured to:

reduce the audio frequency bandwidth of the post-blend demodulated (L+R) and (L−R) signals prior to performing stereo-to-mono blending-if the measured first signal quality metric value is not greater than the maximum signal quality mitigation threshold value; and not reduce the audio frequency bandwidth of the post-blend demodulated (L+R) and (L−R) signals if the measured first signal quality metric value is greater than the maximum signal quality mitigation threshold value.

21. The system of claim 11, where the digital/analog signal blend circuitry is configured to produce post-blend demodulated signals only from the digital demodulated signals obtained from the digital modulated signals contained in the received radio frequency (RF) spectrum; and where the system further comprises signal quality mitigation circuitry configured to perform stereo-to-mono blending operations on post-blend demodulated (L+R) and (L−R) signals produced only from the digital demodulated signals before beginning blending from the digital demodulated signals to the analog demodulated signals.

22. The system of claim 11, where the digital/analog signal blend circuitry is configured to perform the digital/analog blending operation between digital demodulated left and right signals and analog demodulated left and right signals to produce post-blend demodulated left and right signals at the output of the digital/analog signal blend circuitry, and where the system further comprises:

adder and subtraction circuitry having an input coupled to the output of the digital/analog signal blend circuitry and being configured to add post-blend demodulated left and right signals produced by the output of the digital/analog signal blend circuitry to produce a post-blend demodulated (L+R) signal at an output of the adder and subtraction circuitry and to subtract the post-blend demodulated right signal from the post-blend demodulated left signal to produce a post-blend demodulated (L−R) signal at the output of the adder and subtraction circuitry; and signal quality mitigation circuitry having an input coupled to the output of the adder and subtraction circuitry, the signal quality mitigation circuitry including stereo blend circuitry configured to perform one or more stereo blend operations on the post-blend demodulated (L+R) and (L−R) signals produced by the output of the adder and subtraction circuitry.

23. The system of claim 11, where the digital/analog signal blend circuitry is configured to perform the digital/analog blending operation between digital demodulated (L+R) and (L−R) signals and analog demodulated (L+R) and (L−R) signals to produce a post-blend demodulated left plus right (L+R) demodulated signal and a post-blend demodulated left minus right (L−R) signal at the output of the digital/analog signal blend circuitry, and where the system further comprises:

adder and subtraction circuitry having an output coupled to the input of the digital/analog signal blend circuitry and an input coupled to the output of digital demodulator circuitry configured to produce digital demodulated left and right signals obtained from the digital modulated signals contained in the received radio frequency (RF) spectrum, the adder and subtraction circuitry being configured to add the digital demodulated left and right signals produced by the output of digital demodulator circuitry to produce a digital demodulated (L+R) signal at an output of the adder and subtraction circuitry and to subtract the digital demodulated right signal from the digital demodulated left signal to produce a digital demodulated (L−R) signal at the output of the adder and subtraction circuitry; and signal quality mitigation circuitry having an input coupled to the output of the digital/analog signal blend circuitry, the signal quality mitigation circuitry including stereo blend circuitry being configured to perform stereo blend operations on the post-blend demodulated (L+R) and (L−R) signals produced by the output of the digital/analog signal blend circuitry to produce a mitigated output signal from the signal quality mitigation circuitry.

* * * * *